US006244555B1

(12) United States Patent
Benja-Athon

(10) Patent No.: US 6,244,555 B1
(45) Date of Patent: Jun. 12, 2001

(54) FREE-STANDING COMPUTER MONITOR COPY HOLDER FOR PREVENTING REPETITIVE STRAIN INJURY

(76) Inventor: Anuthep Benja-Athon, 210 E. 36$^{th}$ St., Gr. Fl., New York, NY (US) 10016

( * ) Notice: Subject to any disclaimer, the term of this patent is extended or adjusted under 35 U.S.C. 154(b) by 0 days.

(21) Appl. No.: 09/473,039

(22) Filed: Dec. 28, 1999

(51) Int. Cl.$^{7}$ ..... A47B 19/00

(52) U.S. Cl. ..... 248/441.1; 248/442.2; 248/444

(58) Field of Search ..... 248/918, 441.1, 248/442.2, 460, 243, 244, 451, 408, 407

(56) References Cited

U.S. PATENT DOCUMENTS 1,108,687 * 8/1914 Boorman ..... 248/442.2
1,135,752 * 4/1915 Balaban ..... 248/441.1
1,455,603 * 5/1923 Dandridge ..... 248/452
2,317,821 * 4/1943 Stein ..... 248/638
3,200,791 * 8/1965 Swett ..... 248/447
5,085,427 * 2/1992 Finn ..... 482/148
5,709,365 * 1/1998 Howard ..... 248/454

* cited by examiner

*Primary Examiner*—Anita M. King
*Assistant Examiner*—Holly N. Sy

(57) ABSTRACT

A copy holder adaptable to independently stand free of a computer monitor and upright laptop configuration. The copy holder comprises a pedestal frame around the base of computer monitor and upright laptop configuration, two vertical pole members to which couple a vertical frame structure, a pair of vertical axial sleeves interconnects by a horizontal shelf member and an upright plate member. Each vertical pole member has a spring-powered peg. Each vertical axial sleeve has a spring-powered bolt. The vertical frame structure has a plurality of holes. The vertical axial sleeves adjustably move and reversibly fix to a position along the vertical frame structure using two spring-powered bolts to reversibly engage the aforementioned plurality of holes. A plurality of reels, cords and cleats are provided to fasten copy to the copy holder.

19 Claims, 3 Drawing Sheets

FREE-STANDING COMPUTER MONITOR COPY HOLDER FOR PREVENTING REPETITIVE STRAIN INJURY

FIELD OF INVENTION

A free-standing computer monitor copy holder for holding copy in a spatial domain above, behind, in front of and in parallel to a display screen of a computer monitor and upright laptop configuration.

BACKGROUND OF THE INVENTION

This applicant filed an application, patent application Ser. No. 08/539,595, on a computer monitor copy holder which was abandoned. Subsequently, applicant filed a second application, patent application Ser. No. 08/805,007, on 02/24/97 entitled A Version of the Original Computer Monitor Copy Holder For Preventing Repetitive Strain Injury which was abandoned. Subsequently, on Dec. 29, 1997, applicant filed a third application, U.S. Pat. No. 08/998,748, entitled Copy Holder for Thin Computer Monitor for Preventing Repetitive Strain Injury which was abandoned.

The present invention prevents and eliminates repetitive strain injury and cumulative trauma disorders in a computer operator.

Specifically, the present invention prevents and eliminates repetitive strain injury and cumulative trauma disorders of the soft tissues of the neck which directly or indirectly cause pain and disability associate with the use of a computer monitor and an upright laptop configuration.

The present invention is a device that prevents repetitive strain injury to soft tissues of the neck which causes cervicalgia and cervicogenic pain and disorders of head, neck, shoulders, upper extremities, trunk and visceral organs.

The present invention eliminates and reduces the repetitive lateral, turned and rotatory movements of the neck and head of a user of a computer monitor, an upright laptop configuration and a prior art copy holder.

The present invention follows the same ergonomic principles and achieves the objectives setforth in said applications. Specifically, this present invention is a copy holder to be used with any and all types of computer monitors and upright laptop configurations to prevent computer-related repetitive strain injury.

The present invention has many advantages over prior art copy holders.

One of the advantages of the present invention is that the copy holder can be used with any and all types of computer monitors and upright laptop configurations. Another unique feature is that the copy holder of the present invention is a framework adaptable to align and hold copy without being attached to or supported by any component of said computer monitors and upright laptop configurations.

Moreover, it is obvious that the present invention is adaptable to hold, maneuver and align copy with a wide range of weights and dimensions In said applications, the background of the present invention was discussed. This discussion is reiterated as follows.

Cumulative trauma disorders and repetitive strain injuries in workplace to moving body parts of a worker are well known. It is widely recognized among supermarket cashiers, assembly workers, keyboard typists, or in any settings involving repetitive motion. Said injuries are especially common and well recognized among computer operators.

The prevalent thinking is that aforementioned injuries are the result of cumulative and repetitive strain occurring locally to the local tissues of afflicted body part. For example, in carpal tunnel syndrome, it is commonly believed that repetitive stroking of the keys of the computer keyboard by the fingers eventually and causally resulted in the cumulative traumatic disorders of the flexor tendons and tendon sheaths and, consequently, compressive injury to the adjacent median nerve in the same carpal tunnel. However, this hypothesis is most likely incorrect.

Based on aforementioned and other unproven hypotheses, prior art devices are used locally to protect the local structures by attempting to minimize the local trauma to the tissues. Examples of such devices are adjustable split keyboards, wrist pads and forearm supports. Other devices are various types of splints and orthoses for the wrist. However, the effectiveness of these devices remains unproven.

Recently, new scientific evidence indicates that the cause of cumulative trauma disorders and repetitive strain injuries manifested as pain and related symptoms such as paresthesia in the hands, arms, shoulders, torso, neck and head in computer users may be a result of an injury to the neck Cervicogenic problems of the upper body including those of the upper extremities are well documented in the scientific literature. For several years, this patent applicant, who is a physician, has treated daily aforementioned and other cervicogenic problems of the body. Common painful and disabling conditions of the body distant from the neck but are of cervicogenic origin are epicondylitis, bursitis, tendinitis, tenosynovitis, myalgia, neuritis and swelling of distant tissues from the neck, etc.

Lateral and/or rotatory movements and subsequent maintenance of the head in a stationary lateral and/or rotated positions cause substantially more sprain, strain and injury to the cervical joints and soft tissue structures than monoplanar (extension/flexion) movement or maintenance of the head and neck in a stationary anatomically physiologic, non-turned position. Persons with preexisting conditions such as cervical spinal stenosis, arthritic cervical joints and facets, bulging cervical discs are predisposed and more prone to repetitive strain injuries and cumulative trauma disorders. Said injuries eventually occur in an operator who repetitively turn and/or rotate the neck and head and/or hold the neck in a turned position.

Unknowing to computer operators, prior art copy holders cause and promote said undesirable motion. The result is sprain, strain and injury to the cervical joints and soft tissue structures.

In summary, the biomechanics of the human neck is not designed to tolerate said repetitive motion associate with the use of prior art copy holders. Based on the law of physics, said nonphysiologically repetitive motion of the neck cause immense stress, strain, derangement of and trauma to the cervical tissues. In a computer operator with underlying unhealthy cervical structures, such as cervical facet arthritis, herniated intervertebral discs, and worse, cervical spinal stenosis, said injuries quickly ensue.

The present invention eliminates and prevents said injuries and disorders.

SUMMARY OF THE INVENTION

A free-standing copy holder comprises a framework for holding, maneuvering and aligning copy in a spatial domain above, behind, in front of and parallel to a display screen of any and all types of computer monitors and upright laptop configurations.

The copy holder comprises a pedestal adaptable to independently stand free of said computer monitors and upright laptop configurations on a workstation. Said pedestal is a frame comprises a first hemi-elliptical bar member adaptable to couple with a second hemi-elliptical bar member by a male-female joint to form said pedestal around the base of said computer monitors and upright laptop configurations.

The copy holder further comprises two vertical pole members having two spring-powered pegs, a vertical frame structure having a plurality of holes, a pair of vertical axial sleeves having a pair of spring-powered bolts, and an easel comprises an upright rectangular, plastic plate in continuity with a horizontal shelf member.

The vertical pole members are attached to said pedestal frame and adjustably coupled with the vertical frame structure. The vertical axial sleeves fit around the vertical frame structure and adjustably move along the length of the vertical frame structure. The horizontal shelf member of said easel attaches to said vertical axial sleeves and, together with said plastic plate, supports and holds said copy. Said pair of spring-powered bolts reversibly engage said plurality of holes to fix a position of the vertical axial sleeves and the easel. A plurality of reels, cords and cleats are provided on the copy holder to fasten copy to the copy holder.

In addition to aligning copy with said display screen, the copy holder is adaptable to overlap a portion of said copy over the top portion of said display screen.

DESCRIPTION OF THE PREFERRED EMBODIMENTS

Figure 1:
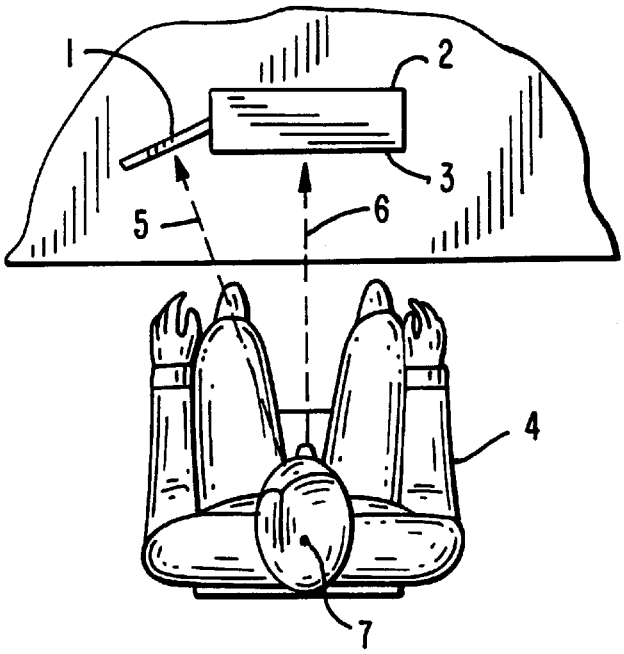
FIG. 1 PRIOR ART
FIG. 1 is an aerial view of the copy holder of prior art.

FIG. 1 is an aerial view showing a computer operator 4 using a prior art computer monitor copy holder 1. Prior art copy holder 1 is placed to the side of and adjacent to a computer monitor 2 and the display screen 3. Using copy holder 1, copy line of sight 5 and display screen line of sight 6 of computer operator 4 are in different planes. Computer operator 4 must repetitively turn the head and neck back and forth between lines 5 and 6 about the vertical axis 7 of the operator's head. Copy holder 1 causes said repetitive turning back and forth of the head and neck of computer operator 4. As a result, cumulative trauma disorders of the neck in computer operator 4 occurs as discussed supra.

Figure 2:
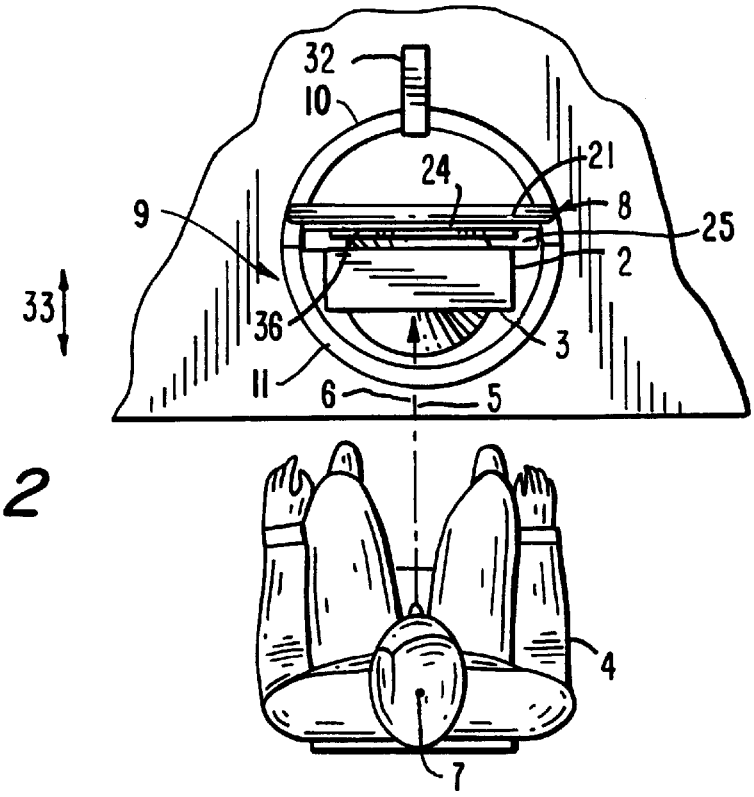
FIG. 2 is an aerial view of the copy holder of the present invention.

FIG. 2 is an aerial view showing computer operator 4 using a thin computer monitor or an upright laptop configuration and the like 2. Thin computer monitor 2 also represents flat-panel computer monitors. The display screen of flat-panel computer monitors and laptop configurations comprises liquid-quartz-crystal-digital screen.

In FIG. 2, computer operator 4 is looking at display screen 3 and copy holder 8 of the present invention. Copy holder 8 aligns copy 36 with display screen 3. Using copy holder 8 as described in detail infra, the copy line of sight 5 and display screen line of sight 6 of computer operator 4 are constantly maintained in one and the same plane. In this setting, there is no turning of the head of computer operator 4 about axis 7. Thus, copy holder 8 eliminates repetitive turning of the head and neck of computer operator 4 about vertical axis 7. As a result, cumulative trauma disorders to the structures of the neck are avoided. The objectives of the present invention are fulfilled.

Furthermore, in FIG. 2, to facilitate the comprehension of the versatility of copy holder 8, a straight bidirection-arrow 33 indicates the adjustable, reversible and fore-and-aft depthwise movement of copy holder 8 and copy 36. Copy 36 can be articles such as, but not limited to, a piece of paper, magazine, book, journal.

Figure 3:
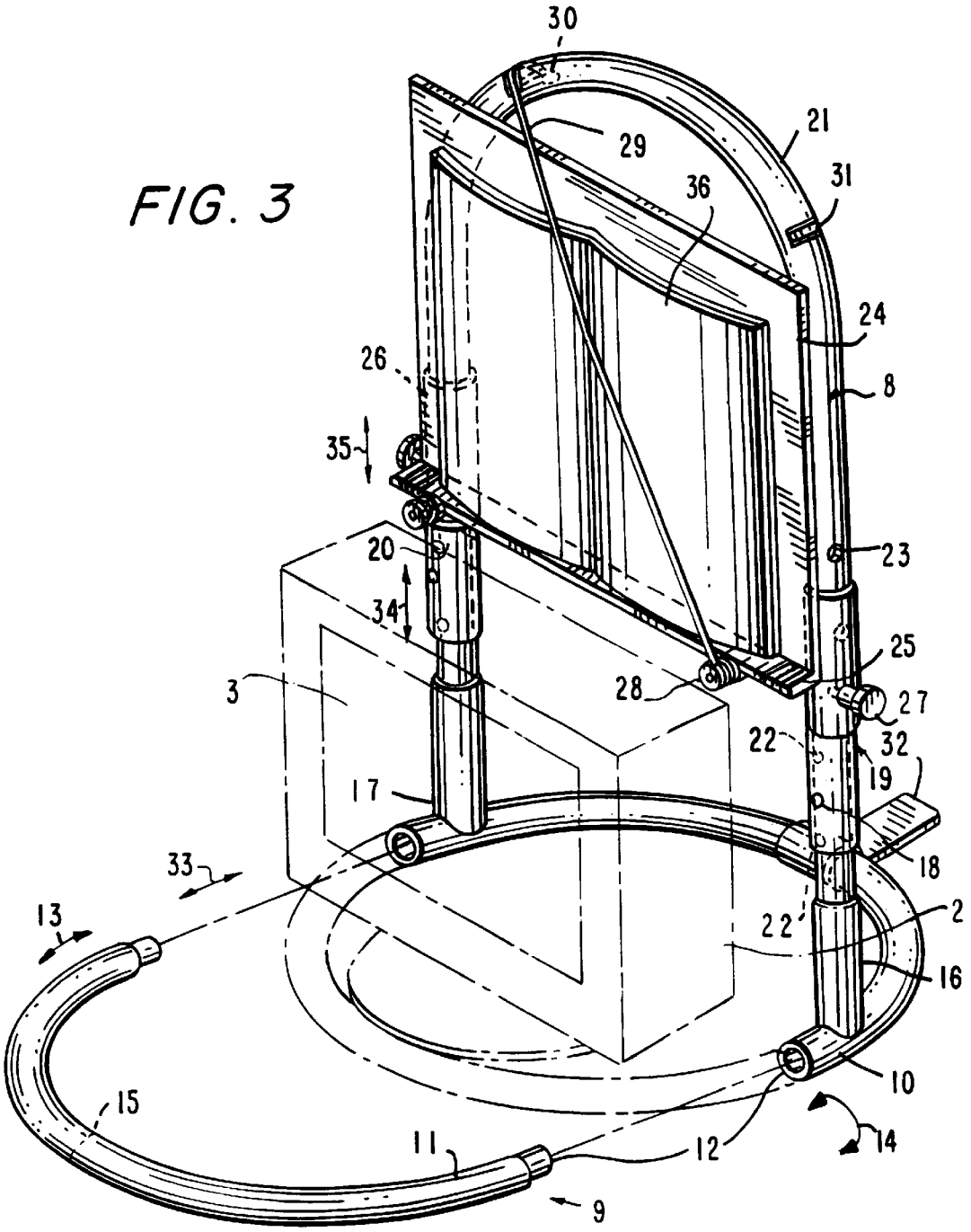
FIG. 3 is a perspective view of copy holder of the present invention.

FIG. 3 is a perspective view of one of the preferred embodiments of copy holder 8. Copy holder 8 adaptable to be used with any and all types of computer monitors such as, but not limited to, cathode-ray-tube and liquid-quartz-crystal-digital types, flat panel monitors, upright laptop configurations and the like 2. It is obvious from this illustration that other equipment with which copy holder 8 can be used are such as, but not limited to, various machines in the home, office and supermarket.

Copy holder 8 independently stands free of a computer monitors and upright laptop configurations 2. In other words, copy holder 8 can hold and align copy without having to attach to a computer monitor and an upright laptop configuration.

Copy holder 8 comprises a pedestal 9. Pedestal 9 is a frame comprises a first hemi-elliptical bar member 10 and an independent second hemi-elliptical bar member 11.

During the manufacturing and transporting processes and prior to the use of copy holder 8, both component members 10 and 11 may be separated as shown in FIG. 2. After first hemi-elliptical bar member 10 is looped around and positioned adjacent to the base of computer monitor and upright laptop configuration 2, second hemi-elliptical bar member 11 may engage first hemi-elliptical bar member 10 as represents by a single bidirection-arrow 13. Said process of engagement of both members 10 and 11 is by coupling both ends of member 10 and both ends of member 11 by a male-female union 12. Said union 12 forms an elliptical pedestal frame around the base of the computer monitor and upright laptop configuration 2.

In another preferred embodiment, second hemi-elliptical bar member 11 may comprise two shorter bar members by a division at 15. The advantage of this division is that each of or both two shorter bar members can be used in a setting wherein said shorter bar members are connected to member 10 by male-female union 12. In said setting, each of two shorter bar members may be turned lateral on both sides of member 10 away from copy holder 8 as represented by a curve bidirection-arrow 14. When laterally turned in said setting, both shorter bar members allow copy holder 8 to accommodate a keyboard (not shown in the figure) of a computer and an upright laptop configurations 2. Furthermore, when laterally turned in said setting both shorter bar members provide an additional support and stability for copy holder 8.

Although elliptical, ring or circular pedestal 9 are some of the preferred embodiments of copy holder 8, it is obvious to one skill in the art that other geometrical designs and shapes such as, but not limited to, oblong, rectangular and square geometry of pedestal 9 can be used. Said designs, shapes and geometry are used to maximize the stability of and the support for copy holder 8. Moreover, said designs, shapes and geometry facilitate the affiliation of copy holder 8 with various dimensions, configurations and geometry of the base of the computers and upright laptop configurations 2 and workstation.

A bracket means for fastening 32 pedestal 9 to a workstation is used. Bracket means 32 stabilizes and fastens copy holder 8 to said workstation. Moreover, bracket means 32 further ensures that copy holder 8 will not be toppled by the weight of copy 36, FIG. 3 further shows pedestal 9 comprises two vertical pole members 16 extending from first hemi-elliptical bar member 10.

First, one of the preferred embodiments can occur during the manufacturing process of first hemi-elliptical bar member 10. In this process, both vertical pole members 16 may be incorporated with said member 10 to form a single unit.

Second, in another preferred embodiment, first hemi-elliptical bar member 10 and two vertical pole members 16 are manufactured as three separate components. Therefore, in the application of copy holder 8 in said setting, all said three separate components may be united at the junction 17 at the workstation by nuts, bolts, ring washers and the like.

Each vertical pole member 16 may be a cylindrical pole having a cylindrical bore. Vertical pole member 16 further comprises a spring-powered peg 18 on a front wall of said cylindrical pole.

Copy holder 8 further comprises a vertical frame structure 19. Vertical frame structure 19 comprises two hollow arm members 20 and a hemi-elliptical cross bar member 21. Hemi-elliptical cross bar member 21 interconnects both hollow arm members 20. Each hollow arm member 20 comprises a cylindrical wall, a cylindrical bore, a plurality of holes 22 on a lower portion of said cylindrical wall and another plurality of holes 23 on an upper portion of said cylindrical wall. Said cylindrical bore of both hollow arm members 20 allows hollow arm members 20 to couple with vertical pole members 16. Vertical frame structure 19, therefore, can move up and down on vertical pole members 16 as represents by a straight bidirection-arrow 34. The plurality of holes 22 on the lower portion of said cylindrical wall of hollow arm member 20 reversibly engage and adjustably couple with spring-powered peg 18 of vertical pole member 16.

Copy holder 8 further comprises a pair of vertical axial sleeves 26. Each vertical axial sleeve 26 bears a spring-powered bolt 27. Both vertical axial sleeves adjustably move up and down along the length of hollow arm members 20 of vertical frame structure 19 as represents by a straight bidirection-arrow 35. Spring-powered bolts 27 can be withdrawn away from sleeve 26 to reversibly engage the plurality of holes 23 on the upper portion of said cylindrical wall of hollow arm members 20 of vertical frame structure 19. As a result, spring-powered bolts 27 affix both vertical axial sleeves 26 at a height above computer monitor and upright laptop configuration 2.

Copy holder 8 further comprises a horizontal shelf member 25 and an upright plate member 24. Horizontal shelf member 25 interconnects vertical axial sleeves 26. Upright plate member 24 is a continuity of horizontal shelf member 25. Both upright plate member 24 and horizontal shelf member 25 support and hold copy 36. Alternatively, an easel, panel or meshwork of cords can be used in place of horizontal shelf member 25 and upright plate member 24. Both upright plate member 24 and horizontal shelf member 25 can be manufactured from various materials such as, but not limited to, transparent plastic which are strong, durable, rigid and able to support a range of weights of copy 36.

A plurality of reels 28 are attached to a front surface member of horizontal shelf member 25 and plate member 24 (not shown in the figure). Each reel 28 houses and incrementally dispenses and retracts an extendable-retractable transparent cord 29. Each reel has the affixing mechanism such as, but not limited to, a latch to fix the length of cord 29 to a specific desired length whereby copy can be firmly held in one stable position on upright plate member 24 and horizontal shelf member 25. At the end of cord 29 is a knob member 30. A plurality of cleats 31 are attached to said front surface member of horizontal shelf member 25, upright plate member 24 and hollow arm members 20 (not shown in this figure) and hemi-elliptical cross bar member 21. The function of reels 28, cords 29, knobs 30 and cleats 31 is to fasten copy 36 to copy holder 8.

Although the support of copy holder 8 is afforded by pedestal 9 and bracket means 32, it is obvious to one skill in the art that other means for engaging pedestal 9 with workstation are such as, but not limited to, nuts, bolts and fasteners.

Figure 4:
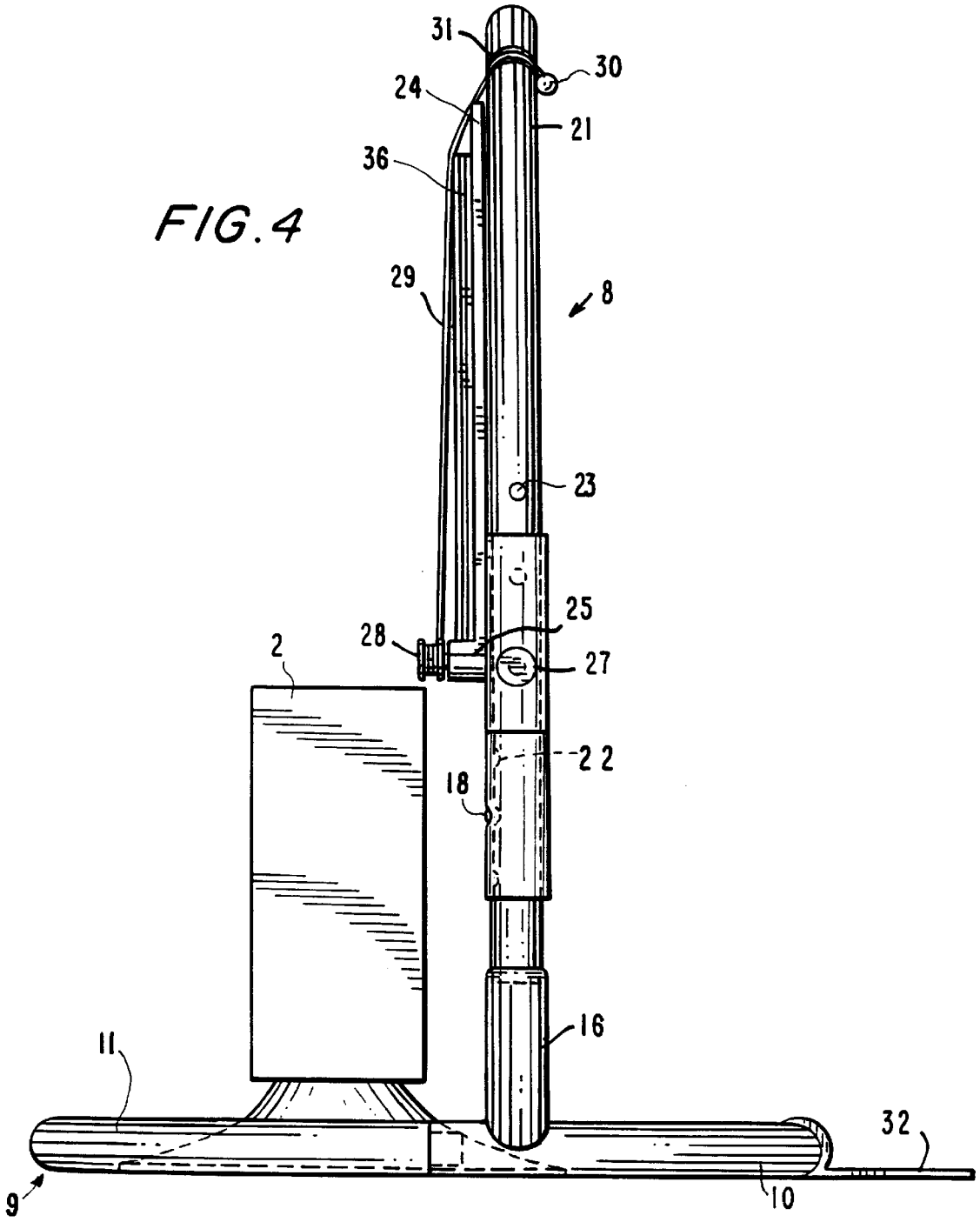
FIG. 4 is a schematic side view of copy holder of the present invention.

FIG. 4 shows the schematic side view of copy holder 8 and its relationship to computer monitor and upright laptop configuration 2.

The unique versatility of copy holder 8 is as follows:

To achieve the objectives as discussed supra, copy holder 8 aligns copy with, positions copy in a vertical plane, at a height above, behind, in front of and parallel to display screen 3 in said spatial domain. In addition by combining said maneuvering and positioning, copy holder 8 is adaptable to partially overlap a portion of copy 36 in front of and over the top portion of display screen 3.

First, in FIGS. 2 and 3, copy holder 8 can move and hold copy 36 in fore-and-aft depthwise direction relative to display screen 3 of computer monitor and upright laptop configuration 2 as represents by a straight bidirection-arrow 33.

Second, two vertical pole members 16, vertical frame structure 19 and vertical axial sleeves 26 position copy 36 in a vertical plane, at a height above and behind computer monitor and upright laptop configuration 2 and display screen 3. Said movement and positioning are represented by straight bidirection-arrows 34 and 35.

Third, the combination of said movement and positioning, pedestal 9 in said fore-and-aft depthwise movement also aligns and positions copy 36 in a vertical plane, at a height above, in front of and parallel to display screen 3. Said movement and positioning are represented by straight bidirection-arrows 33, 34 and 35.

Fourth, the combination of said movement and positioning, copy holder 8 adaptable to partially overlap a portion of copy 36 over the top portion of display screen 3. Said movement and positioning are represented by straight bidirection-arrows 33, 34 and 35.

Copy holder 8 and all of its components can be manufactured from various materials such as, but not limited to, metals, alloys, plastics and various other man-made substances which are light, durable, strong and able to support copy 36 weighing from a few ounces to many pounds.

Having described the preferred embodiments of the present invention, it is to be understood that the present invention is not limited to said precise embodiments. Various changes, adaptations, modifications, configurations and geometrical designs of copy holder 8 may be effected by individual skills in the art and science without departing from the spirit of the present invention and the scope of the claims.

Further, it is obvious that the present invention could be adapted, used and applied in other circumstances and with other objects and machines such as, but not limited to, any other computer monitors, televisions, cashier machines, calculators, display monitors without departing from the spirit of the present invention and the scope of the claims.

What is claimed is:

1. A copy holder means for holding, maneuvering and aligning copy in a spatial domain above, behind and in front of a display screen of a computer monitor and upright laptop configuration adaptable to independently stand free and separate from said computer monitor and upright laptop configuration and to align said copy with, to position said copy in a vertical plane, at a height above, behind, in front of and parallel to said display screen in said spatial domain and to partially overlap a portion of said copy in front of and over the top portion of said display screen to prevent repetitive strain injury, comprises:

a pedestal frame for encircling around the base of said computer monitor and upright laptop configuration;

means for positioning said copy holder means for holding, maneuvering and aligning said copy;

means for maneuvering said copy holder means for holding, maneuvering and aligning said copy in a fore-and-aft depthwise position;

means for adjustably aligning said copy in said spatial domain above, behind and in front of and parallel to said display screen;

means for vertically aligning said copy in a vertical position in said spatial domain above, behind and in front of said display screen;

means for vertically adjusting a height of said copy in said spatial domain above, behind and in front of said computer monitor and upright laptop configuration;

means for partially overlapping a portion of said copy in front of and over a top portion of said computer monitor and upright laptop configuration; and means for stabilizing said copy holder means;

means for fastening said copy to said copy holder means.

2. The copy holder means according to claim 1 wherein said means for positioning said copy holder means for holding, maneuvering and aligning said copy is a pedestal comprising:

said pedestal frame comprising a first hemi-elliptical bar member;

a second hemi-elliptical bar member; and two vertical pole members extending above and from said first hemi-elliptical bar member, each of said vertical pole members has a spring-powered peg on a front wall of said vertical pole member.

3. The copy holder means for holding, maneuvering and aligning said copy in a spatial domain above, behind and in front of a display screen according to claim 1 comprises a vertical frame structure comprising:

two hollow arm members, each of said hollow arm members has a cylindrical wall, a cylindrical bore, a hemi-elliptical cross bar member connecting said hollow arm members;

a plurality of holes in a lower portion of said cylindrical wall of said hollow arm member;

a plurality of holes in an upper portion of said cylindrical wall of said hollow arm member; and said means for fastening said copy to said copy holder means.

4. The copy holder means for holding, maneuvering and aligning said copy in a spatial domain above, behind and in front of a display screen according to claim 1 further easel comprising:

an upright rectangular, transparent, plastic plate in continuity with a horizontal, transparent shelf member;

said horizontal, transparent shelf member comprises a front surface member and back a surface member and two ends, said horizontal, transparent shelf member is attached to a vertical axial sleeve at each of said end of said horizontal, transparent shelf member; and said means for fastening said copy to said copy holder.

5. The copy holder means according to claim 1 wherein said means for maneuvering said copy holder means for holding, maneuvering and aligning said copy in a fore-and-aft depthwise position is said pedestal frame.

6. The copy holder means according to claim 1 wherein said means for adjustably aligning said copy in said spatial domain above, behind and in front of and parallel to said display screen is said pedestal frame.

7. The copy holder means according to claim 1 wherein said means for adjustably aligning said copy in said spatial domain above, behind and in front of and parallel to said display screen is an upright rectangular, transparent, plastic plate in continuity with a horizontal, transparent shelf member.

8. The copy holder means according to claim 1 wherein said means for vertically aligning said copy in a vertical position in said spatial domain above, behind and in front of said display screen is a vertical frame structure.

9. The copy holder means according to claim 1 wherein said means for vertically aligning said copy in a vertical position in said spatial domain above, behind and in front of said display screen is an upright rectangular, transparent, plastic plate in continuity with a horizontal, transparent shelf member.

10. The copy holder means according to claim 1 wherein said means for vertically adjusting a height of said copy in said spatial domain above, behind and in front of said computer monitor and upright laptop configuration is a vertical frame structure.

11. The copy holder means according to claim 1 wherein said means for vertically adjusting a height of said copy in said spatial domain above, behind and in front of said computer monitor and upright laptop configuration is an upright rectangular, transparent, plastic plate in continuity with a horizontal, transparent shelf member.

12. The copy holder means according to claim 1 wherein said means for vertically adjusting a height of said copy in said spatial domain above, behind and in front of said computer monitor and upright laptop configuration is a pair of vertical axial sleeves, each of said vertical axial sleeves has a spring-powered bolt.

13. The copy holder means according to claim 1 where in said means for partially overlapping a portion of said copy in front of and over a top portion of said computer monitor and upright laptop configuration is a vertical frame structure.

14. The copy holder means according to claim 1 where in said means for partially overlapping a portion of said copy in front of and over a top portion of said computer monitor and upright laptop configuration is an upright rectangular, transparent, plastic plate in continuity with a horizontal, transparent shelf member.

15. The copy holder means according to claim 1 where in said means for partially overlapping a portion of said copy in front of and over a top portion of said computer monitor and upright laptop configuration is a pair of vertical axial sleeves, each of said vertical axial sleeves has a spring-powered bolt.

16. The copy holder means according to claim 1 wherein said means for fastening said copy to said copy holder means comprises a plurality of reels adaptable to house and incrementally dispense a plurality of extendable-retractable transparent cords, each of said cords has a knob member attached to a free end of said cord.

17. The copy holder means according to claim 1 wherein said means for fastening said copy to said copy holder means is a plurality of cleats.

18. The copy holder means according to claim 1 wherein said means for stabilizing said copy holder means is a bracket.

19. A copy holder means for holding, maneuvering and aligning copy in a spatial domain above, behind and in front of a display screen of a computer monitor and upright laptop configuration adaptable to align said copy with, to position said copy in a vertical plane, at a height above, behind, in front of and parallel to said display screen in said spatial domain and to partially overlap a portion of said copy in front of and over the top portion of said display screen, comprises:

a pedestal frame for encircling the base of said computer monitor and upright laptop configuration;

means for positioning said copy holder means for holding, maneuvering and aligning said copy;

means for maneuvering said copy holder means for holding, maneuvering and aligning said copy in a fore-and-aft depthwise position;

means for adjustably aligning said copy in said spatial domain above, behind and in front of and parallel to said display screen;

means for vertically aligning said copy in a vertical position in said spatial domain above, behind and in front of said display screen;

means for vertically adjusting a height of said copy in said spatial domain above, behind and in front of said computer monitor and upright laptop configuration;

means for partially overlapping a portion of said copy in front of and over a top portion of said computer monitor and upright laptop configuration; and means for stabilizing said copy holder means;

means for fastening said copy to said copy holder means.

* * * * *